United States Patent [19]

Borostyan

[11] 4,304,026

[45] Dec. 8, 1981

[54] CLEANING APPARATUS FOR A XEROGRAPHIC REPRODUCTION MACHINE

[75] Inventor: Stephen Borostyan, Victor, N.Y.

[73] Assignee: Xerox Corporation, Stamford, Conn.

[21] Appl. No.: 80,608

[22] Filed: Oct. 1, 1979

[51] Int. Cl.[3] ..... G03G 15/00

[52] U.S. Cl. ..... 15/308; 355/15

[58] Field of Search ..... 15/1.5 R, 308; 355/15

[56] References Cited

U.S. PATENT DOCUMENTS

| | | | |
|---|---|---|---|
| 3,590,412 | 7/1971 | Gerbasi | 355/15 X |
| 3,879,124 | 4/1975 | Eppe et al. | 355/15 |
| 3,932,910 | 1/1976 | Shimoda | 355/15 X |

*Primary Examiner*—Chris K. Moore

[57] ABSTRACT

An improved cleaning apparatus for cleaning a photoreceptor in a xerographic reproduction machine includes a rotatably mounted circular cleaning brush and a flicker member within a housing. A portion of the flicker member is in contact with the brush to produce a primary flicking of the brush bristles as the brush rotates out of contact with this portion. Formed in this portion of the flicker member is an aperture in the form of a slot to produce a secondary flicking of the brush bristles as the brush rotates over this portion. The flicker member is contoured so that the angle between the tangents to the flicker member and brush roll surface at the point of initial contact is very small, approximately 5°, but gradually increases to a maximum of approximately 45° before the brush rotates out of contact with the flicker member. A vacuum chamber behind the flicker member communicates with a prenip region adjacent the periphery of the brush through a vacuum aperture formed in a portion of the flicker member not in contact with the brush. This causes a major portion of the air drawn from the exterior of the housing to be drawn through the brush into the prenip region and through the slot and vacuum aperture. An air inlet is formed in the housing adjacent to where the brush rotates out of contact with the flicker member to permit air to be drawn through the housing in the general direction of rotation of the brush.

13 Claims, 3 Drawing Figures

CLEANING APPARATUS FOR A XEROGRAPHIC REPRODUCTION MACHINE

BACKGROUND OF THE INVENTION

The present invention relates to an improved cleaning apparatus for a xerographic reproduction machine, but more particularly to a cleaning apparatus which has improved cleaning capability, i.e., one which can remove large amounts of residual toner particles from a photoreceptor for a much longer period of time than heretofore possible without becoming contaminated by the toner.

With the introduction of xerographic high speed duplicating machines using magnetic brush development, cleaning of the photoreceptor has become increasingly important because of the large amounts of toner used in a given time. In cleaning apparatus using a circular cleaning brush rotatably mounted inside a housing, the cleaning brush and the inside of the housing rapidly become contaminated with toner which eventually causes the toner to be redeposited onto and thus "filming" the photoreceptor. As can be seen, when this happens, cleaning efficiency falls off very rapidly, Thus, what is needed is an improved cleaning apparatus which is capable of operating for longer periods of time than was heretofore possible before becoming contaminated with toner.

SUMMARY OF THE INVENTION

The primary object of this invention is to construct a vacuum brush cleaner that reduces photoreceptor filming and has improved cleaning capability. The level of photoreceptor filming is reduced by keeping the fibers of a circular brush cleaner than was heretofore possible. This is accomplished by reducing the power dissipated between the circular brush and a flicker member which it contacts during operation. Experimental evidence shows that the impact forces between a cleaning brush and a flicker member are determined by the geometry of the flicker member. The larger the angle between the individual brush fibers and a flicker member at the initial point of contact the larger will be the deceleration of the fibers and the heat generated. Heat causes toner to become caked onto the cleaning brush, thus causing the photoreceptor to become "filmed". By reducing the amount of heat generated and by combining aerodynamics with mechanical flicking action, the cleaning brush and the inside of the cleaner housing can be kept free of toner for a longer period of time than was heretofore possible.

The cleaning capability is improved by producing air flows in the brush housing and through the brush-photoreceptor nip that remove the dislodged toner particles from the brush and the housing more effectively. Experimental evidence shows that increasing the air flow through the brush-photoreceptor nip in the direction of brush rotation, results in earlier and more efficient dislodging of toner from the photoreceptor surface. The toner that is dislodged and outside the brush is removed from the housing by a high velocity air stream provided by flicker bar-housing configuration. The dislodged toner that remains between the brush fibers is efficiently removed by the proposed flicker bar.

The present invention utilizes a circular brush which is rotatably mounted within a housing, the housing being located adjacent to a photoreceptor to be cleaned.

The cleaning brush removes the toner from the photoreceptor, and a flicker member is used to remove toner particles from the brush. The flicker member has a portion thereof in contact with a portion of the brush to provide flicking of the brush bristles as the latter rotate out of contact with this portion of the flicker member. The flicker member is contoured so that the angle between the flicker member and the brush fibers at the point of initial contact is approximately 5°, but within a general range of approximately 0° to 15°. Formed in the portion of the flicker member in contact with the brush is a plurality of rows of apertures in the form of slots which are parallel to the axis of rotation of the brush. Each of these slots has a leading edge and a trailing edge, the trailing edges of the slots being rounded to reduce the impact forces of the brush fibers against the apertures. On the side of the flicker member opposite to the side in contact with the brush is a chamber which is connected via a vacuum conduit to a suitable vacuum source. This enables toner particles dislodged from the brush fibers to be drawn through the slots into the chamber and directed away to a suitable collection container. A third aperture is formed in a portion of the flicker member which is not in contact with the brush. This aperture or opening is directed into a prenip area adjacent the periphery of the brush and permits air to be drawn from the exterior of the housing through the brush in the general direction of the rotation of the brush and into the prenip region. Also included is an air inlet formed in the housing adjacent to where the brush rotates out of contact with the flicker member, and a second vacuum conduit for causing air to flow through this air inlet into the housing and through the brush in the general direction of the rotation of the brush. This enables toner particles ejected from the brush fibers to be carried through this second vacuum conduit to a suitable collection receptacle.

DETAILED DESCRIPTION OF THE INVENTION

Figure 1:
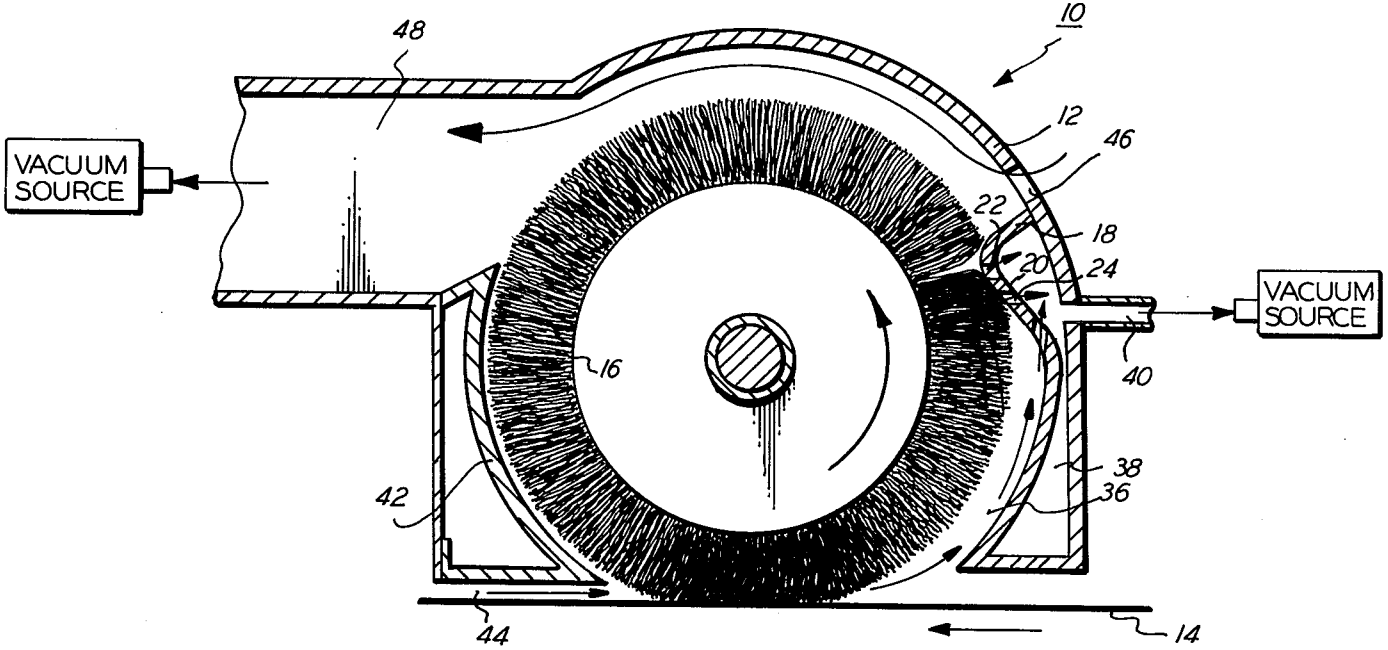
FIG. 1 is a schematic sectional view of the preferred embodiment of the present invention mounted adjacent to the photoreceptor which is to be cleaned.
Figure 3:
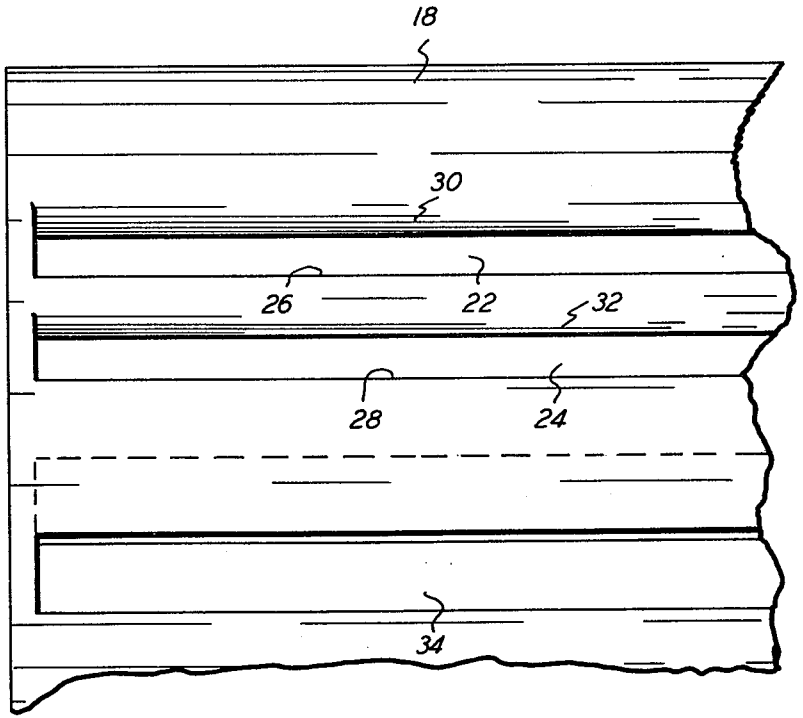
FIG. 3 is a view taken along line 3—3 of FIG. 2 showing the parallel rows of slots and the vacuum aperture.
Figure 2:
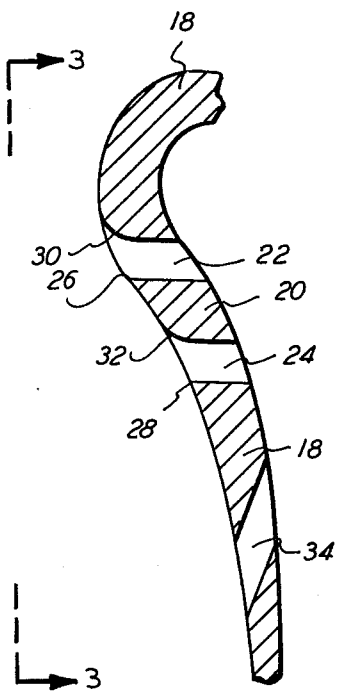
FIG. 2 is an enlarged sectional view of the flicker member showing the parallel rows of slots and the vacuum aperture in the flicker member.

Referring to FIG. 1, the operation of the present invention will now be described in detail. A cleaning apparatus 10 includes a housing 12 which is mounted adjacent to a photoreceptor 14 to be cleaned. Rotatably mounted within the housing 12 is a circular brush 16 which is mounted to rotate in a direction which is tangentially opposite to that of the photoreceptor 14. Mounted within the housing 12 is a flicker member 18 which has a portion 20 in contact with the brush 16 to provide a flicking of the brush bristles as the latter rotate out of contact with this portion of the flicker member. Referring to FIGS. 2 and 3, it can more easily be seen that the flicker member 18 contains two apertures 22 and 24 which are in a form of slots which are parallel to the axis of rotation of the brush 16. These slots have leading edges 26 and 28 respectively, and trailing edges 30 and 32 respectively. A vacuum aperture 34 is formed in a portion of the flicker member 18 which is not in contact with the brush. As can be seen, aperture 34 is directed downwardly into a prenip region 36 formed between the periphery of the brush 16 and the lower portion of the flicker member 18. On the side of the flicker member 18 which is opposite to that portion of the flicker member in contact with the brush is a chamber 38 which is connected by a conduit 40 to a suitable vacuum source.

As can be seen in FIG. 1, by directing the vacuum aperture 34 downwardly into the prenip region, and by locating a postnip air baffle 42 immediately adjacent to but not touching the tips of the bristles of the brush 16, a major portion of the air drawn from the exterior of the housing 12 is drawn through a space 44, through the brush in the general direction of the rotation of the brush, and into the prenip region 36. Thus, toner which is mechanically removed by the brush 16 from the photoreceptor 14 and flicked into the prenip region 36 is carried by a high flow of high velocity air through the vacuum conduit 34 into the vacuum chamber 38 and out through the conduit 40 to a suitable collection receptacle. Also, toner particles flicked off of the brush bristles by the slots 22 and 24 are likewise carried into the vacuum chamber 38 and out through the vacuum conduit 40.

After the brush bristles have passed the slots 22 and 24 they will rotate out of contact with portion 20 of the flicker member 18, and any toner particles remaining on the brush fibers are flicked therefrom at this time. As can be seen, an air inlet 46 is formed in the housing 12 adjacent to where the brush rotates out of contact with the flicker member 18. As can be seen, a second vacuum conduit 48 is located so as to cause air to flow through the air inlet 46 and through the housing and brush in the general direction of the rotation of the brush. Thus, any toner particles flicked from the brush bristles will be entrained by the air stream and carried out through the vacuum conduit at 48 to a suitable collection receptacle.

As can be seen the bristles of the brush 16 do not contact the vacuum aperture 34 during rotation of the brush 16. The initial point of contact of the brush fibers with the flicker member 18 is made slightly above the vacuum aperture 34. At this initial point of contact, the angle between the flicker member 18 and the fibers of the brush is approximately 5° but may vary between 0° and approximately 15°. As stated above, experimental evidence has shown that the impact forces between the brush fibers and the flicker member are determined by the geometry of the flicker member. To minimize the deceleration of the tips of the brush fibers and consequently the heat generated, initial contact should be at a small angle. Thus, the flicker member 18 is contoured so that the angle between the tangents to the flicker member and the brush roll surface at this initial point of contact is between approximately 0° and 15°. As the brush 16 continues to rotate, the angle between the brush fibers and flicker member gradually increases to a maximum of approximately 45°.

Thus, with the present invention, three factors cooperate to keep the cleaning brush and housing free of toner contamination for a longer period of time which consequently reduces photoreceptor filming. These three factors are (1) the mechanical flicking action of the brush fibers caused by the slots 22 in 24 and the flicking member 18, (2) the aero-dynamics of the system which causes toner flicked loose from the brush fibers to be entrained in air streams and carried out of the cleaner housing 12, and (3) the contour of the flicking member 18.

While the invention has been described with reference to the structure disclosed, it is not confined to the details set forth, but is intended to cover such modifications or changes as may come within the scope of the following claims.

What is claimed is:

1. An improved cleaning apparatus for cleaning residual toner particles from a photoreceptor comprising a housing located adjacent the photoreceptor, a circular cleaning brush rotatably mounted within the housing and in contact with the photoreceptor for removing the toner particles from the photoreceptor, a flicker member for removing the toner particles from the brush, the flicker member having a portion thereof in contact with a portion of the brush to provide a first flicking of the brush bristles as the latter rotate out of contact with this portion of the flicker member, the improvement comprising:

means formed in the portion of the flicker member in contact with the brush for producing a second flicking of the brush bristles across at least substantially the entire width of the brush having toner particles thereon as the brush rotates over this portion, said second flicking means being a slot means.

2. An improved cleaning apparatus as set forth in claim 1, wherein the slot means is a plurality of slots which are parallel to the axis of rotation of the brush.

3. An improved cleaning apparatus as set forth in claim 2, wherein the slots are apertures.

4. An improved cleaning apparatus as set forth in claim 3 wherein each aperture has a leading edge and a trailing edge, and wherein the trailing edge is rounded to reduce the impact forces of the brush fibers against each aperture.

5. An improved cleaning apparatus as set forth in claim 1, wherein the flicker member is contoured so that the angle between the flicker member and brush fibers at the point of initial contact is between 0° and 15°.

6. An improved cleaning apparatus as set forth in claim 5, wherein the slot means is a plurality of slots which are parallel to the axis of rotation of the brush.

7. An improved cleaning apparatus as set forth in claim 6, wherein the slots are apertures.

8. An improved cleaning apparatus as set forth in claim 7, wherein each aperture has a leading edge and a trailing edge and wherein the trailing edge is rounded to reduce the impact force of brush fibers against each aperture.

9. An improved cleaning apparatus as set forth in claim 5, wherein the second flicking means is an aperture in the form of a slot, the aperture having a leading edge and a trailing edge, the trailing edge being rounded to reduce the impact forces of the brush fibers against said aperture.

10. An improved cleaning apparatus as set forth in claim 9, which further includes means for creating a vacuum on the side of the flicker member opposite to the side in contact with the brush.

11. An improved cleaning apparatus as set forth in claim 10, and further including means defining a prenip region adjacent the perimeter of the brush between where the brush contacts the photoreceptor and where the brush contacts the flicker member, and means including the vacuum creating means for causing a major portion of air drawn from outside the housing to flow through the brush in the general direction of rotation of the brush and into the prenip region.

12. An improved cleaning apparatus as set forth in claim 10, which further includes means forming an air inlet in the housing adjacent to where the brush rotates out of contact with the flicker member, and means for causing air to flow through the air inlet into the housing and through the brush in the general direction of the rotation of the brush.

13. An improved cleaning apparatus as set forth in claim 11, which further includes means forming an air inlet in the housing adjacent to where the brush rotates out of contact with the flicker member, and means for causing air to flow through the air inlet into the housing and through the brush in the general direction of the rotation of the brush.

* * * * *